US008485645B2

(12) United States Patent
Oki et al.

(10) Patent No.: US 8,485,645 B2
(45) Date of Patent: Jul. 16, 2013

(54) LIQUID EJECTING APPARATUS

(75) Inventors: Narihiro Oki, Matsumoto (JP); Tsunenobu Endo, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 918 days.

(21) Appl. No.: 11/852,024

(22) Filed: Sep. 7, 2007

(65) Prior Publication Data

US 2008/0088654 A1 Apr. 17, 2008

(30) Foreign Application Priority Data

Sep. 8, 2006 (JP) ..... 2006-244713
Sep. 8, 2006 (JP) ..... 2006-244714
Aug. 30, 2007 (JP) ..... 2007-223539

(51) Int. Cl.
*B41J 2/165* (2006.01)

(52) U.S. Cl.
USPC ..... 347/55

(58) Field of Classification Search
None
See application file for complete search history.

(56) References Cited

U.S. PATENT DOCUMENTS 5,170,185 A * 12/1992 Takemura et al. ..... 347/55
5,329,307 A * 7/1994 Takemura et al. ..... 347/151
7,367,654 B2 5/2008 Togashi et al.
7,472,985 B2 1/2009 Endo et al.
2003/0071885 A1* 4/2003 Kamoshida et al. ..... 347/112
2005/0212871 A1* 9/2005 Kadomatsu et al. ..... 347/76
2006/0181576 A1* 8/2006 Endo et al. ..... 347/55
2006/0181577 A1* 8/2006 Endo et al. ..... 347/55
2006/0187265 A1* 8/2006 Endo ..... 347/55
2007/0052745 A1* 3/2007 Izuo ..... 347/14

FOREIGN PATENT DOCUMENTS

JP 11-078012 3/1999
JP 11-245390 9/1999
JP 2000-006420 1/2000
JP 2000-318159 11/2000
JP 2001-232798 8/2001
JP 2002-137415 5/2002
JP 2004-202867 7/2004
JP 2005-015141 1/2005
JP 2005-186313 A 7/2005
JP 2005-349799 A 12/2005
JP 2006-231635 9/2006
JP 2006-231635 A 9/2006

* cited by examiner

*Primary Examiner* — Matthew Luu
*Assistant Examiner* — Alejandro Valencia
(74) *Attorney, Agent, or Firm* — Maschoff Brennan

(57) ABSTRACT

A liquid ejecting apparatus which can reduce transportation failure, enhance device safety, and consume lower power in an apparatus including a liquid electing head, an absorbing member, an electrode, and a potential difference creating unit, by controlling the duration of a high voltage application period by controlling the voltage from the potential difference creating unit using a liquid collection control unit.

8 Claims, 12 Drawing Sheets

LIQUID EJECTING APPARATUS

BACKGROUND OF THE INVENTION

1. Field of the Invention

The present invention relates to a liquid ejecting apparatus, and more particularly to a liquid ejecting apparatus which attaches liquid ejected from orifices of a nozzle plate mounted in a liquid ejecting head to a recording object.

2. Description of the Related Art

In liquid ejecting apparatuses, when attaching liquid to the entire area of a recording object leaving no margin uncovered with the liquid near the edges of the recording object, the liquid is ejected to over a slightly wider area than the dimension of the recording object, considering inevitable misalignment between the recording object and the liquid ejecting head. Accordingly, the liquid is also ejected to a region where the recording object is not present, which is near the side edges and the upper and lower edges of the recording object. Accordingly, an absorbing member is disposed outside the recording object at a position facing the liquid ejecting head so as to absorb the remainder of the liquid which is ejected from the liquid ejecting head but not attached to the recording object. With such a structure, it is possible to prevent outskirts of the recording object from being smudged by the remainder of the liquid which is not attached to the recording object.

By the way, when the liquid is attached to the recording object, a portion of the recording object, to which the liquid is attached, is apt to expand and to thereby wrinkle. If wrinkles come into contact with the absorbing member, the liquid absorbed in the absorbing member may contaminate the recording object. Accordingly, in a number of liquid ejecting apparatuses, a gap of 2 to 4 mm is provided between the recording object and the absorbing member, considering the height of the wrinkles of the recording object. In similar manner, in order to prevent the recording object from being smudged due to the contact between the wrinkles of the recording object and the absorbing medium, a gap of 1 mm is provided between the nozzle plate and the recording object. Accordingly, in total, a gap of 3 to 5 mm is provided between the nozzle plate and the absorbing member.

On the other hand, on purpose to enhance resolution of an image formed on the recording object by attaching the liquid to the recording object, liquid droplets are ejected from orifices of the nozzle plate is atomized further. A single liquid droplet has a size of several pl. Since each of such minute liquid droplets has very a small mass, the liquid droplets rapidly lose their kinetic energy due to viscous resistance of ambient gas after they are ejected from the nozzle plate. For example, after liquid droplets each having a size smaller than 8 pl travel a distance of about 3 mm in the air, flight velocity of the liquid droplets decreases to almost zero. It takes a long period for the minute liquid droplets that completely lost their kinetic energy to fall to a target position because the falling motion attributable to the gravitational acceleration and the viscous resistance of ambient are balanced. The liquid droplets suspending in the air until they arrive at the target position is called aerosol.

Some of the aerosol produced in such a manner escapes from the liquid ejecting apparatus, suspending away outward and then sticks to objects in surroundings. On the other hand, most of the aerosol sticks to elements in the liquid ejecting apparatus. In the case in which the aerosol sticks to a transportation path of the recording object, such as platen, succeeding recording objects become contaminated due to reattaching of the aerosol. In the case in which the aerosol is attached to electric circuits, linear scales, rotary encoders, optical sensors, and the like mounted in the liquid ejecting apparatus, the attachment of aerosol brings about device malfunction. In addition, if a user touches a spot to which the aerosol is attached, the user's hand gets stained.

Patent document 1 discloses a liquid ejecting apparatus having a function of actively collecting aerosol using an electric field. In the liquid ejecting apparatus disclosed in the document, an absorbing member is arranged in a position facing a nozzle plate on purpose to attract and absorb the remainder of the liquid droplets which is not attached to the recording object. A metal member serving as one electrode is arranged close to the absorbing member and the nozzle plate made of a metal and provided with orifices, from which liquid is ejected, serves as a counter electrode.

If different voltages are applied to the electrode and the nozzle plate, respectively, an electric field is generated between them. On the other hand, liquid droplets ejected from the nozzle plate are electrified to have the same polarity as the nozzle plate due to lighting rod effect as soon as the liquid droplets are ejected from the nozzle plate. Accordingly, minute liquid droplets which can become aerosol continuously fly toward the electrode without velocity loss thanks to Coulomb force generated by the electric field, and are then attached to the electrode having the reverse polarity. Further, the liquid droplets attached to the electrode are absorbed by the absorbing member arranged close to the electrode by capillarity.

Patent Document: JP-A-2004-202867

SUMMARY OF THE INVENTION

As described above, it can be seen that it is possible to suppress generation of aerosol which suspends in the air due to an electric field by the use of electrified state of the aerosol. However, in the liquid ejecting apparatus having such a function, voltages are continuously applied to the electrodes. Accordingly, new technical tasks attributable to such a function have arisen.

One exemplary problem is the unintentional increase in power consumption in the case in which an electrical field is generated over the entire driving period of the liquid ejecting apparatus. A further problem is that a user may get an electrical shock when the user touches a member such as an electrode generating electric power because such a member is applied with a high voltage. A still further problem is that generation of an excessive electric field leads to the decrease in the lifespan of a battery pack because a voltage supply period of a high-voltage voltage source is limited.

A yet further problem is that the electrical field acts to affect a recording object, and thus transportation failure of the recording object occurs because the recording operation is performed in the ambient of electric fields used so as to collect aerosol. In particular, in the case in which the recording object is thin and flexible, the recording object has high dielectric constant attributable to surface processing and coating layer forming or in the case in which the recording object is made of a material, which is flexible and thus can be easily electrified, such as resin film, the recording object is electrified by the electrical field and thus the recording object is attracted toward a structure of the liquid ejecting apparatus. To this end, the recording object comes to be out of alignment with a transportation path, so it happens that transportation failure, such as paper jam occurs.

A yet further problem to be solved is that it happens that the aerosol is attached to an unintentional region in the recording object since the aerosol, which is not attached to the recording object and thus suspends, continuously keeps its kinetic energy due to the electric field. The smudge is highly conspicuous on the back surface of the recording object, which is not intended for the liquid to be attached. In addition, in the case in which the recording is supposed to be performed with respect to the back surface of the recording object as well as on the front surface, such smudge is beyond a problem of deterioration of appearance. As described above, if the electrical field is generated on purpose to prevent a smudge attributable to aerosol form occurring, unpredicted different kinds of smudge can occur.

The present invention is made in order to solve at least some of the above-mentioned problems and can be realized by the following configurations and applications.

First Application

A liquid ejecting apparatus includes a liquid ejecting head including a conductive nozzle plate with orifices and ejecting liquid toward a recording object from the orifices thereof, an absorbing member being disposed at a position farther from the liquid ejecting head in a liquid ejecting direction than the recording object so as to face the nozzle plate, and absorbing the remainder of the liquid, which is ejected from the liquid ejecting head but not attached to the recording object, an electrode disposed close to the absorbing member, a potential difference creating unit creating a potential difference between the nozzle plate and the electrode by applying a voltage to the electrode so as to form an electrical field so the liquid ejected from the liquid ejecting head is electrically attracted to the electrode, and a liquid collection control unit controlling a voltage application period of the potential difference creating unit.

According to this application, a liquid collecting function becomes effective when the need arises by controlling voltage application of the potential difference creating unit by the use of the liquid collection control unit, and thus it is possible to suppress power consumption and to control an application period of a high voltage. This contributes to enhancement of safety of the liquid ejecting apparatus. Further, since the liquid collecting function becomes effective when the need arises, it is possible to suppress smudge attributable to the liquid and the recording object transportation failure to the minimum.

Second Application

In the liquid ejecting apparatus, the liquid collection control unit selects one control mode from control modes including either a first control mode or a second control mode on the basis of information on the recording object and controls to start or stop the voltage application in the selected control mode.

In the application, the control mode relating to starting and stopping of the voltage application is selected on the basis of information about the recording object. Accordingly, the above-mentioned advantages can be properly achieved so as to correspond to the recording object.

Third Application

In the liquid ejecting apparatus, the liquid collection control unit starts the voltage application after the recording object comes into contact with a paper supply roller but before the recording object reaches a position where the liquid is ejected from the orifices to the recording object.

In this application, since the voltage application is continued until the liquid is ejected, the liquid collecting function becomes securely effective and thus it is possible to inhibit smudge attributable to the liquid.

Fourth Application

In the liquid ejecting apparatus, the liquid collection control unit starts the voltage application after the recording object comes into contact with a paper discharge roller.

In this application, a voltage is applied after the recording object is nipped by the paper discharge roller and is stably positioned, it is possible to inhibit the smudge of the recording object, which is attributable to the fact that the recording object is attracted toward the absorbing member due to the electric field, or to suppress occurrence of transportation failure of the recording object, which is attributable to the fact that the recording medium deviates from a transportation path, even in the case in which the recording object is apt to be electrified.

Fifth Application

In the liquid ejecting apparatus, the liquid collection control unit performs the voltage application after the recording object is displaced from a position where the liquid is ejected from the orifices to the recording object.

Since the voltage application is suspended while the liquid is not ejected, it is possible to suppress power consumption. In addition, since a period, in which a high voltage is applied, is limited, this application contributes to enhancement of safety of the liquid ejecting apparatus. In further addition, since the effective electric field is generated before the liquid ejection, it is possible to effectively collect the liquid.

Sixth Application

In the liquid ejecting apparatus, the liquid collection control unit stops the voltage application when a casing of the liquid ejecting apparatus is opened.

In this application, it is possible to prevent the electrode from being exposed in the air when the electrode is applied with a voltage. This leads to enhancement of safety of the liquid ejecting apparatus.

Seventh Application

In the liquid ejecting apparatus, the liquid collection control unit suspends the voltage application when it is detected that things other than the recording object comes into the casing of the liquid ejecting apparatus.

In this application, it is possible to prevent electrical shock, that can occur when the short-circuit occurs by the foreign matters or when trying to get rid of the foreign matters, and thus this leads to enhancement of safety of the liquid ejecting apparatus.

In addition, the above general outline may not include all features of the invention. Accordingly, sub-combinations of feature groups can be the invention.

DESCRIPTION OF THE PREFERRED EMBODIMENTS

Hereinafter, embodiments of the invention will be described but the following embodiments must not be understood to limit the scope of the invention relating to claims. Further, it does not always mean that all combinations of features described relating to the embodiments are necessary for means for solving the problems.

Figure 1:
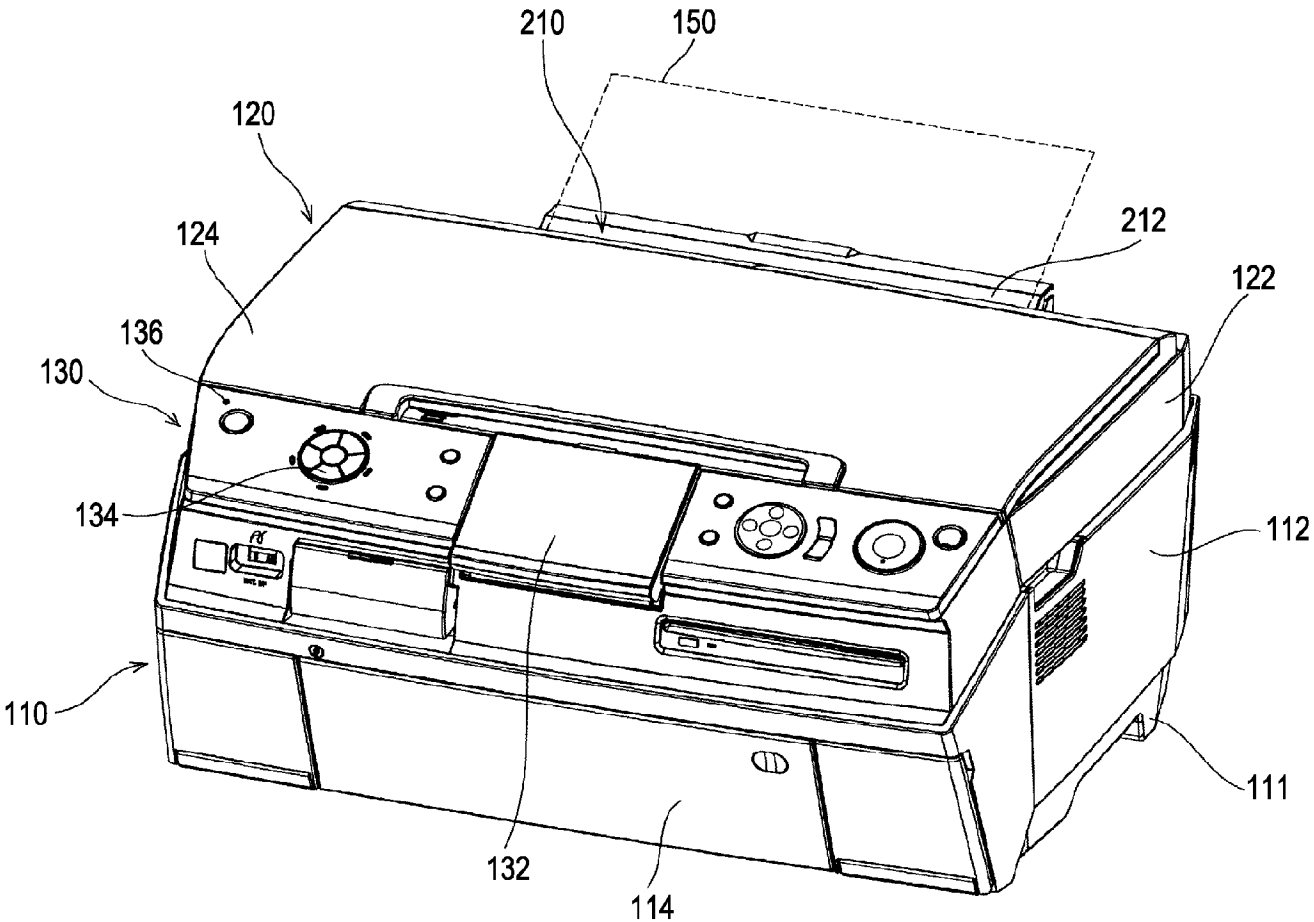
FIG. 1 is a perspective view illustrating overall structure of a recording reading multifunction device.

FIG. 1 is a perspective view illustrating appearance of a recording reading multifunction device 100 including a recording unit 110 equipped with an ink jet type liquid ejecting head according to one embodiment of the invention. The recording reading multifunction device 100 records an image on a recording medium 150 serving as a recording object in a manner of ejecting ink, which is liquid, using a liquid ejecting head.

In FIG. 1, the recording reading multifunction device 100 includes the recording unit 110 and an upper casing 122 disposed over the recording unit 110. The casing 122 has a case shape and has a reading unit disposed 120 therein.

The recording unit 110 includes a lower casing 112 and a feeding unit 210. The lower casing 112 has a case shape and has a casing bottom 111 in a lower position thereof.

The feeding unit 210 has a paper support 212 and is disposed on the back side of the lower casing 112. A front cover 114 is disposed on the front side of the lower casing 112.

On the other hand, on the outer surface of the upper casing 122 is provided a reading table (not shown), on which an original manuscript is mounted, and a cover 124 which also functions as a copy holder which holds the original manuscript on the reading table.

A manipulation panel 130 is provided in front of the cover 124. The manipulation panel 130 includes a display panel 132 and other elements including a plurality of manipulation buttons 134 and a pilot lamp 136. Accordingly, the manipulation panel 130 can receive a variety of instructions and display operation conditions in the case in which the recording reading multifunction device 100 operates in a standalone manner.

In the recording reading multifunction device 100, the cover 124 is opened and an image in the original manuscript mounted on the reading table is read out from the underside surface of the manuscript. The recording medium 150, charged to the paper support 212, is transported toward an inner space of the recording unit 110 and an image is recorded during the transportation of the recording medium 150.

Figure 2:
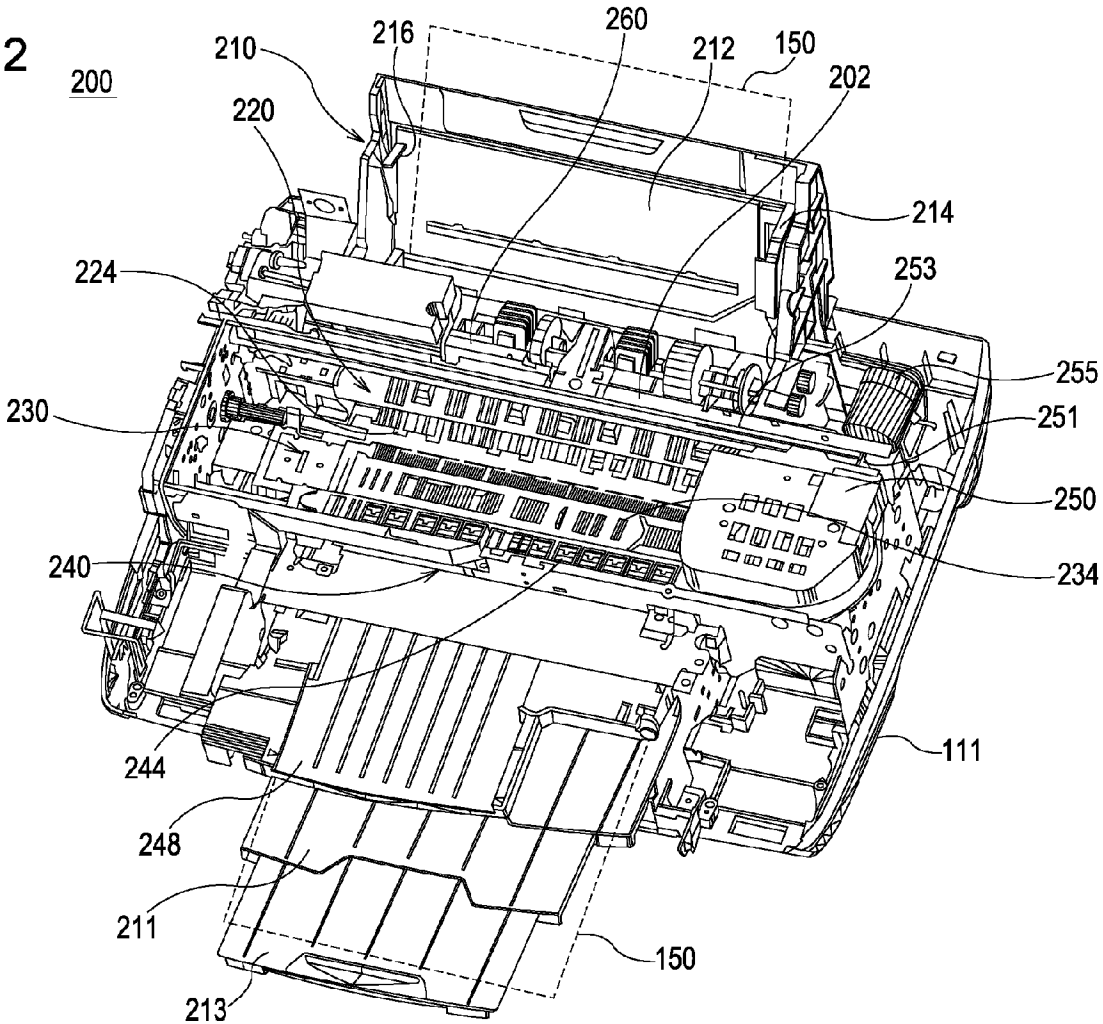
FIG. 2 is a perspective view illustrating an internal mechanism of a recording unit.
Figure 3:
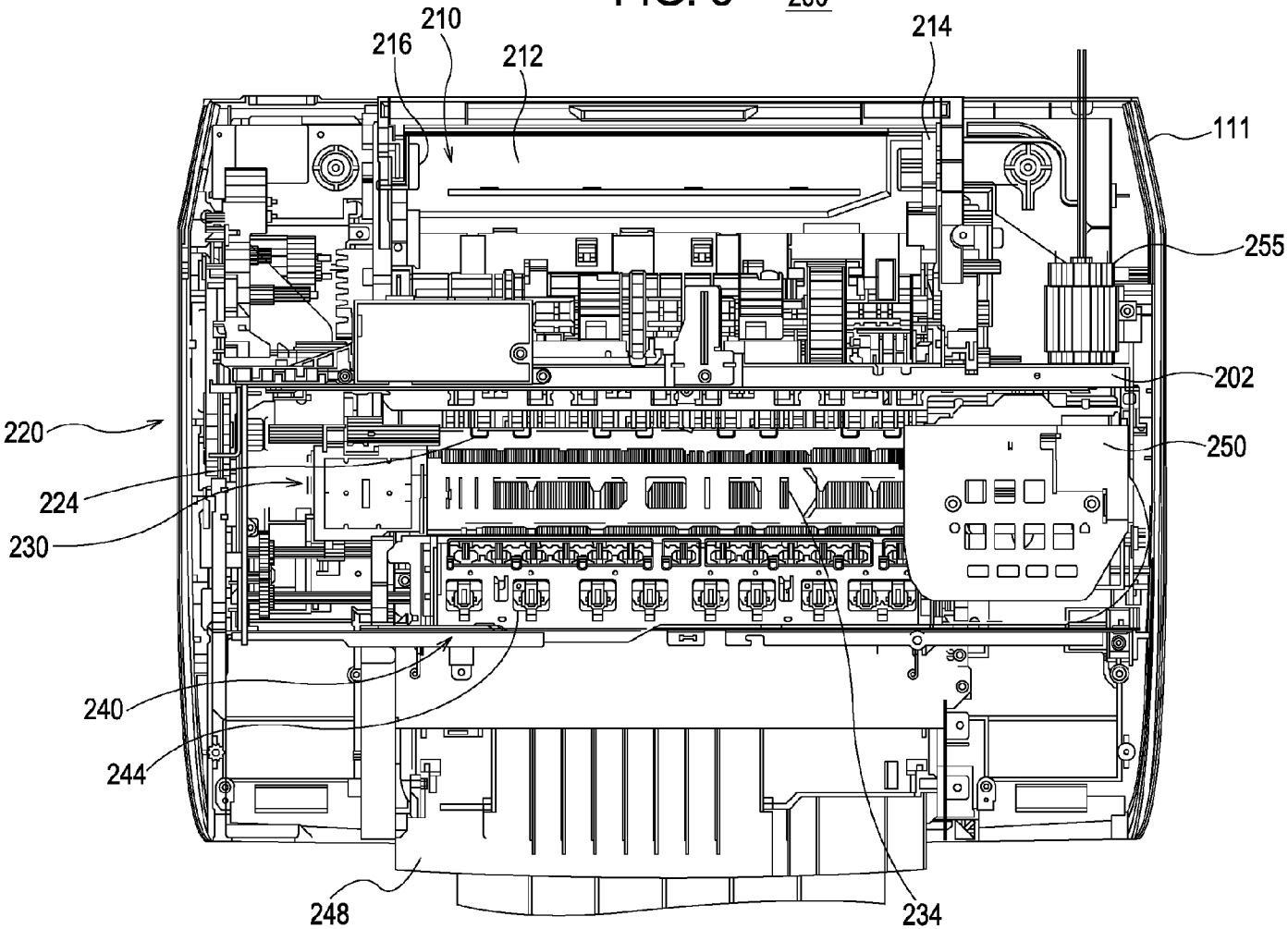
FIG. 3 is a top plan view illustrating the internal mechanism.

FIG. 2 is a perspective view illustrating an internal mechanism 200 of the recording unit 110 drawn out from the recording reading multifunction device 100 shown in FIG. 1. FIG. 3 is a plan view taken by observing the internal mechanism 200 from the top side thereof.

In FIGS. 2 and 3, the internal mechanism 200 includes the casing bottom 111, a frame 202 standing erect on the casing bottom 111, a feeding unit 210 disposed on the back side the frame 202, and a transporting unit 220, a platen 230, and a discharging unit 240 which are arranged in this order in front of the frame 202.

The feeding unit 210 includes a paper support 212 supporting a back surface of the recording medium 150 charged in a longitudinal direction, a side support 214 determining location of the right side edge of the recording medium 150, and a slide support 216 disposed close to the left side edge of the recording medium 150 and preventing the recording medium 150 from inclining. The slide support 216 can horizontally move on the surface of the paper support 212 and thus can abut against the side edge of the recording medium 150 even in the case in which the recording media 150 having different sizes in width are electrified. The feeding unit 210 further includes a feeding roller hidden behind the frame 202 and introduces a plurality of recording media 150 mounted on the paper support 212 into the internal mechanism 200 sheet by sheet while the recording unit 110 performs recording.

In addition, the internal mechanism 200 includes a horizontal paper support 211 of which the front side is open.

The paper support 211 supports the recording medium 150 from the underside, which is horizontally charged from the front side of the internal mechanism 200. Further, it is possible to send the recording medium 150 which is horizontally charged so as to be on the paper support 211 to the transporting unit 220 using the feeding unit 210. The paper support 211 includes an extended portion 213 and can support the recording medium 150 which is longer than the inner size thereof.

The transporting unit 220 includes a transportation driven roller 224 serving as a paper feeding roller which is arranged in front of the frame 202, abuts against the upper surface of the introduced recording medium 150, and thus is rotated. A transportation driving roller rotated by a transporting motor (not shown) is arranged right under the transportation driven roller 224. Accordingly, the recording medium 150 charged into the internal mechanism 200 is tightly held by the transportation driving roller 224 and is transferred so as to be on the platen 230 as the transportation driving roller is rotated.

The platen 230 has a plurality of ribs 234 protruding upward. The ribs 234 abut against the lower surface of the transferred recording medium 150 at their leading ends, thereby determining height and orientation of the recording medium 150. The recording medium 150 passed over the platen 230 comes to finally arrive at a discharging unit 240.

The discharging unit 240 is arranged in front of the platen 230 and is equipped with a discharge driven roller 244 rotated by abutting against the upper surface of the recording medium 150 transferred passing over the platen 230. A discharge driving roller, rotationally driven by a transporting roller via a rotation transferring mechanism (not shown), is arranged right under the discharge driven roller 244. The recording medium 150 is tightly pressed against the transportation driving roller by the discharge driven roller 244, and the discharge driving roller sends the recording medium 150 toward the recording unit 110 by the rotating motion thereof. A discharging tray 248 is arranged in front of the discharging unit 240, and the discharged recording medium 150 is stacked on the discharging tray 248.

In addition, the internal mechanism 200 includes a carriage 250 reciprocating above the platen 230. The carriage is installed so as to horizontally move in a main scanning direction along a guide member (not shown) which is disposed in front of the frame 202 and extends in the main scanning direction. A timing belt 253 is arranged in front of the frame 202 so as to elongate between a pair of pulleys 251. The carriage 250 is connected to the timing belt 253 at the back surface thereof.

One pulley 251 is rotationally driven by a carriage motor 255, and thus the carriage 250 moves according to the displacement of the timing belt 253. Accordingly, it is possible to move the carriage 250 upward from an arbitrary region on the platen 230 by controlling operation and rotating direction of the carriage motor 255. The carriage 250 is provided with the liquid ejecting head (not shown) disposed on the underside thereof.

In the recording reading multifunction device 100 including the internal mechanism 200 having such a structure, recording media 150 charged on the paper support 211 on the front side or on the paper support 212 on the back side is introduced into the transporting unit 220 by the feeding unit 210 sheet by sheet. The recording media 150 introduced into the transporting unit 220 pass over the platen 230, then arrive at the discharging unit 240, and finally are sent out of the internal mechanism 200 by the discharging unit 240.

When the recording medium 150 exists on the platen 230, the liquid ejecting head ejects ink downward while the carriage 250 performs reciprocating motion above the platen 230. As a result, the ink is ejected to and can be attached to an arbitrary region on the surface of the recording medium 150. In addition, the recording medium 150 is intermittently transported by an amount of one row, and the carriage 250 reciprocally moves in a period in which transporting motion is suspended. Thus, it is possible to record an image at an intended region over the entire surface of the recording medium 150.

A control unit 260 controlling a series of recording operations is mounted on the back surface of the frame 202. The control unit 260 controls the recording unit 110 so as to perform proper operations on the basis of instructions inputted through information devices connected to the recording reading multifunction device 100 and instructions inputted through the manipulation panel 130. The control unit 260 is an interface unit receiving image information to be recorded by the recording unit 110. The image information inputted to the control unit 260 may include information about recording quality, such as resolution of an image to be recorded and the number of kinds of colors and information about a recording object, such as dimension and material besides information about the image.

Figure 4:
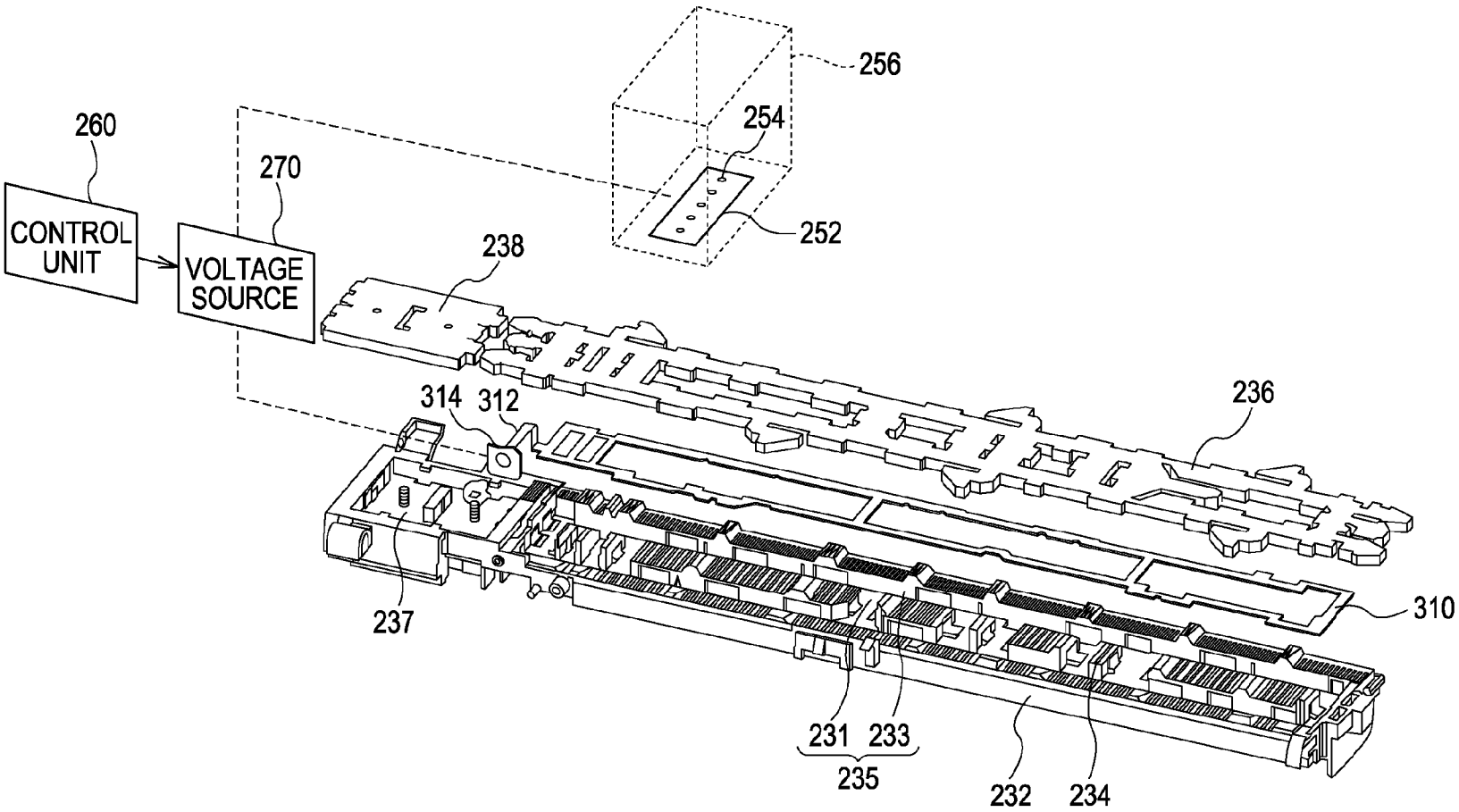
FIG. 4 is an exploded perspective view illustrating structure of a platen.

FIG. 4 is an exploded perspective view illustrating a detailed structure of the platen 230 in the internal mechanism. FIG. 4 shows all of the liquid ejecting head 256, the control unit 260, and the voltage source 270 serving as potential difference creating unit controlled by the control unit in a simplified manner. The liquid ejecting head 256 includes a nozzle plate 252 with orifices 254, and ink is ejected from the orifices 254.

In FIG. 4, the platen 230 includes a platen body 232, and an electrode 310 and an absorbing member 236, 238 received in the platen body 232.

The platen body 232 is an integrally formed resin material. The platen body 232 includes a plurality of ribs 234 protruding upward from the upper surface, wider receiving portions 235, in which each wider receiving portion is a depression formed on the upper surface of the platen body 232 and defined by the bottom 231 and sidewalls 233 and has a relatively large width, and narrower receiving portions 237 disposed in a region in which the ribs 234 are provided. In the case in which the recording medium 150 shown in FIGS. 1 and 2 passes over the platen 230, the upper ends of the ribs 234 abut against the lower surface of the recording medium 150, and thus, the position (in height direction) of the recording medium 150 is determined.

The absorbing member 236, 238 has a size and a shape that can fill the receiving portions 235 and 237. A material of the absorbing member 236, 238 is selected considering absorbing speed of liquid on the surface thereof as an important fact. Here, an absorbing capacity of the absorbing member 236, 238 is limited. Accordingly, a waste liquid absorbing member (not shown) having a larger ink absorbing capacity than the absorbing member 236, 238 is additionally disposed under the platen 230.

In addition, the platen 230 includes an electrode 310 disposed under the absorbing member 236 in each wider receiving portions 235. The electrode 310 is arranged so as to cover almost the entire bottom 231 of each wider receiving portion 235. An extended portion 312 extending outward so as to protrude from the side wall 233 of the wider receiving portion 235 and a terminal portion 314, which is visible from the outside of the platen 230, are integrally formed and provided to an end of the electrode 310. The electrode 310 is connected to an end of a voltage source 270 operating under the control of the control unit 260 via the terminal portion 314, and thus it is possible to apply a voltage to the electrode 310. A remaining end of the voltage source 270 is connected to the nozzle plate 252 provided to the liquid ejecting head 256. With such a structure, it is possible to create a potential difference between the nozzle plate 252 and the electrode 310 and thus it is possible to generate an electric field.

In addition, a foam of resin such as polyethylene, polyurethane, and the like can be properly exemplified as a material for the absorbing member 236, 238. It is further preferable that the absorbing member 236 be made of a conductive material having a surface resistance equal to or less than $10^8\Omega$ on purpose to make potentials of the absorbing member 236 and the electrode 310 equal to each other. As such a material, a material prepared by mixing a conductive material such as metal, carbon, and the like with resin such as polyethylene, polyurethane, and the like and by foaming such a mixture, a material prepared by attaching a conductive material such as metal, carbon, and the like to a resin foam such as polyethylene, polyurethane, and the like, or a material prepared by plating a resin foam such as polyethylene, polyurethane, and the like with a conductive material, such as metal, carbon, and the like can be exemplified. Still further, a material prepared by impregnating resin foam such as polyethylene, polyurethane, and the like with electrolyte can be used.

On the other hand, as a material for the electrode 310, a metal having corrosion resistance against ink, such as wire, plate, or clad member made of gold, stainless steel, or nickel; wire, plate, and clad member plated with such a metal; a net-form member formed by a combination of the above-mentioned ones; and a lattice form member formed by a combination of the above-mentioned ones can be used. According to another embodiment, a coating film layer, a plating layer, a thick film layer, a thin film layer, and the like which are directly formed on the bottom 231 of the receiving portion 235 of the platen 230 can be used as the electrode 310.

Figure 5:
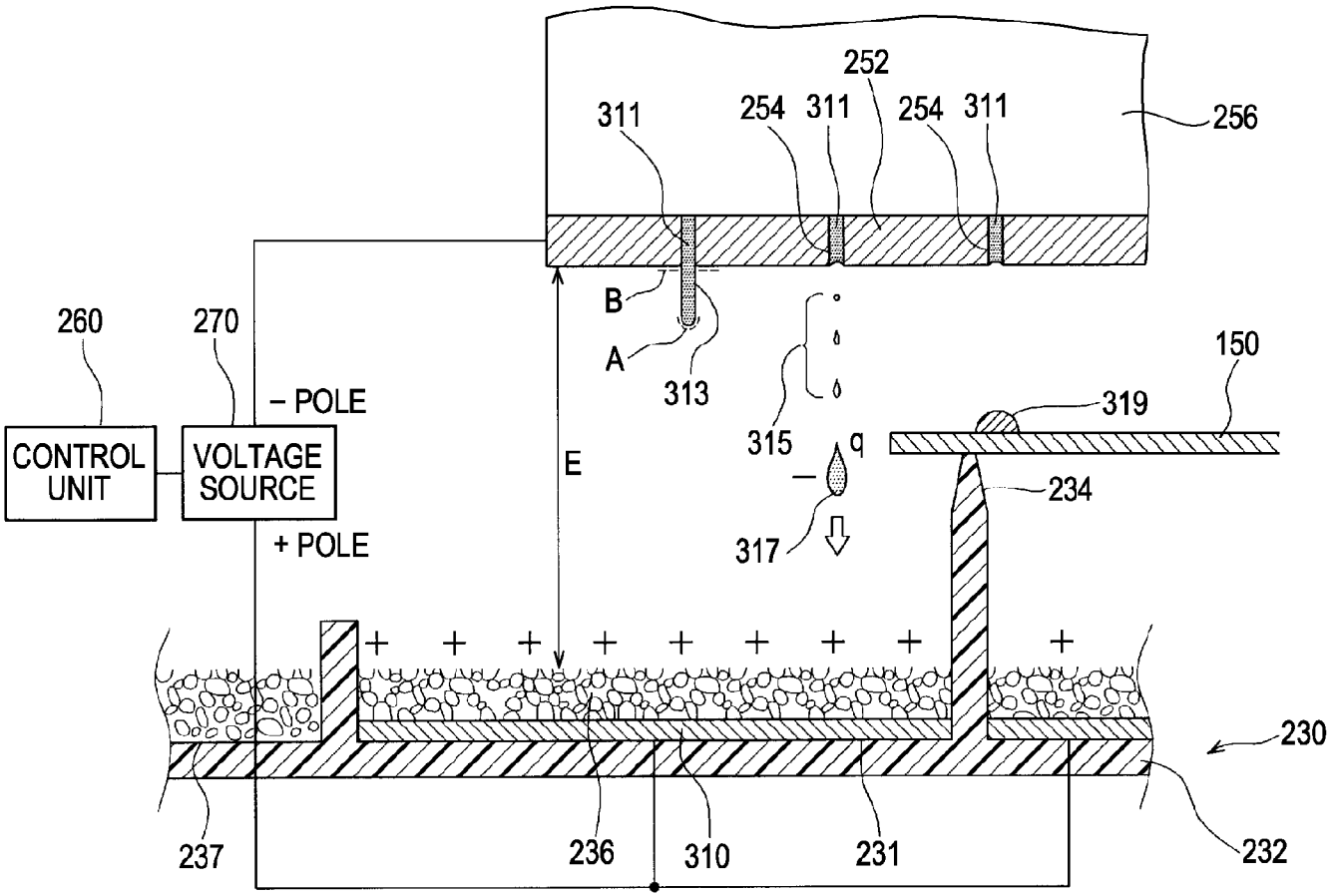
FIG. 5 is a schematic for explaining operation of an aerosol collecting mechanism.

FIG. 5 is a schematic view illustrating structure and operation of an aerosol collecting mechanism 300 composed of the platen 230, the nozzle plate 252, the control unit 260, and the voltage source 270.

In FIG. 5, the nozzle plate 252 is made of, for example, a metal so as to have a conductive characteristic. The nozzle plate 252 is connected to the negative pole of the voltage source 270. On the other hand, the positive pole of the voltage source 270 is connected to the electrode 310 received in the platen 230. The absorbing member 236 disposed over the electrode 310 and received in the platen 230 has a conductive characteristic and the absorbing member 236 has the same potential as the electrode 310 as a whole. Accordingly, an electric field E is generated between the lower surface of the nozzle plate 252 and the surface of the absorbing member 236 due to a potential difference created by the voltage source 270. In addition, even in the case in which reverse polarities are connected to the nozzle plate 252 and the absorbing member 236, the same function can be realized.

The nozzle plate 252 is installed on the lower surface of the liquid ejecting head 256. During the recording operation, ink 311 is ejected downward through the orifices 254. Here, in the case in which the recording medium 150 supported by the platen 230 exists under the orifices 254, the ejected ink 311 is attached to the upper surface of the recording medium 150 and thus forms an image 319. On the other hand, in the case of intending to attach the ink 311 to the recording medium 150 without remaining a margin near the edges of the recording medium 150, it can happen that the recording medium 150 does not exist right under some of the orifices 254 around the side edges, the front edge, and the back edge of the recording medium 150. In such a case, the ink is ejected from the nozzle plate 252 and but flies in the air, not being attached to the recording medium 150.

Ink droplets 317 which are not ejected from the orifices 254 but not attached to the recording medium 150 rapidly lose their kinetic energy due to viscous resistance of the ambient. To this end, the ink droplets 317 lose their kinetic energy long before they arrive at the absorbing member 236. Here, since each ink droplet 317 has a very small mass, when the ink droplets 317 lose their kinetic energy, falling motion attributable to acceleration of gravity and viscous resistance are balanced, and thus falling speed becomes vary low. For such a reason, aerosol suspending under the nozzle plate 252 is generated. Further, some of ink droplets 317 breaks into shreds and thus satellite ink 315 which is more minute than the ink droplet is formed and this also becomes aerosol.

However, in such an aerosol collecting mechanism 300, the electric field E is formed between the surface of the absorbing member 236 and the lower surface of the nozzle plate 252. Accordingly, each ink droplet 317 having a charge q obtains its kinetic energy due to Coulombic force Fe (qE) applied by the electric field E, moves downward without velocity loss, and reaches the absorbing member 236.

In addition, the ink 311 which is forced out of the orifices 254 forms ink pillars 313 drooping from the nozzle plate 252 at a moment right before it becomes ink droplets 317 after leaving the nozzle plate 252. At this time, charges are accumulated between leading ends A of the ink pillars 313 and regions B near the ink pillars 313 in the lower surface of the nozzle plate 252 due to the lighting rod effect. Due to the lighting rod effect, the ink droplet 317 is electrified with a charge q larger than a charge corresponding to a horizontal sectional area of each ink pillar 313. In addition, the lighting rod effect means a phenomenon that a region B of the surface of the nozzle plate 252, which is surrounded in a circular corn having the top, which is the leading end A of the ink pillar 313, and a vertex angle in the range from 50° to 60° contributes to electrification of the ink droplet 317. To this end, the ink droplet 317 flies to the absorbing member 236 with the stronger columbic force applied thereto in the electric field E.

Figure 6:
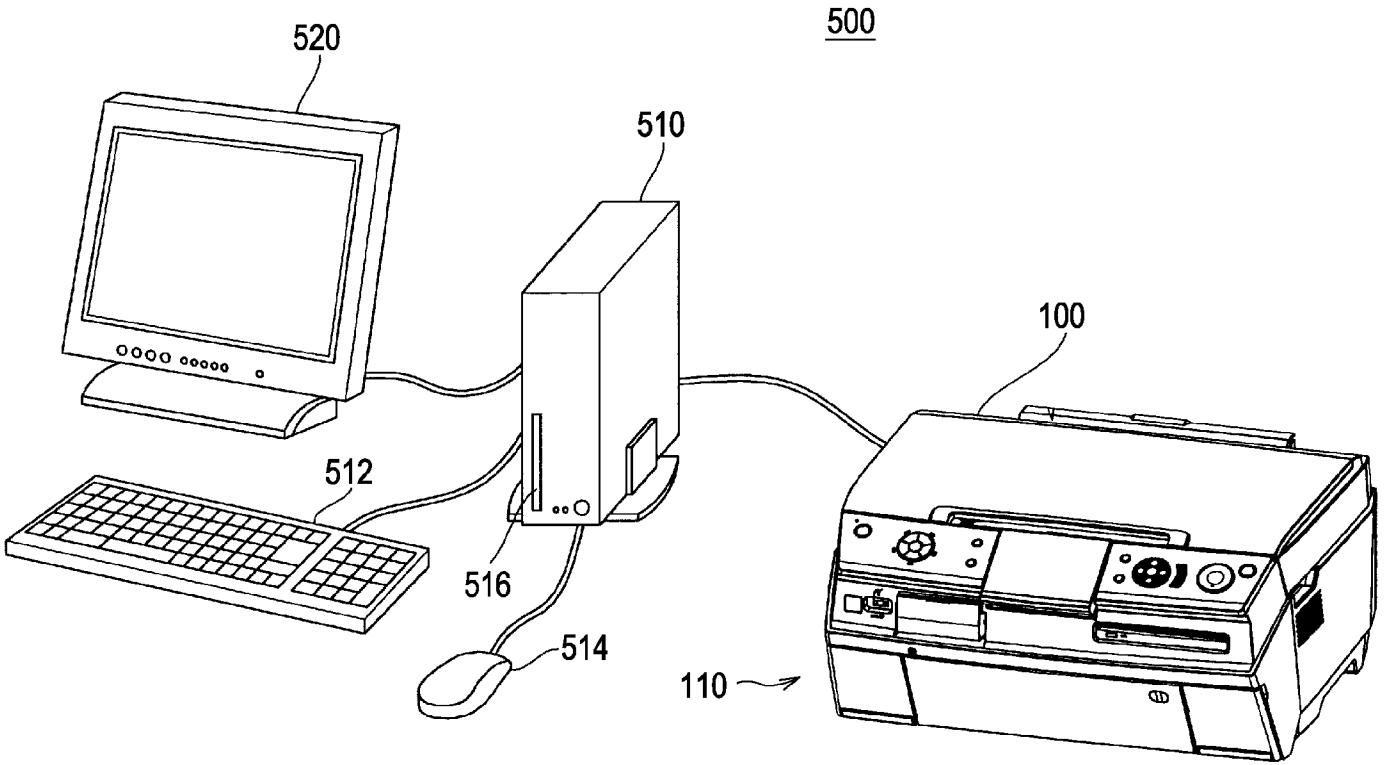
FIG. 6 is a schematic view illustrating structure of a system including the recording reading multifunction device.

FIG. 6 is a schematic view illustrating a system structure in the case of driving the recording reading multifunction device 100 including the recording unit 110 which has the control unit 260 shown in FIG. 5 and performs the control operation according to the above-described sequence.

In the system 500 shown in FIG. 6, the control unit 260 of the recording reading multifunction device 100 shown in FIG. 5 is connected to an information processing device 510 serving as a host device. The information processing device 510 includes a keyboard 512 and a mouse 514 which are units for receiving an input from a user, and a display device 520 which displays an image to the user.

The information processing device 510 includes a disk driver 516 which can record and read information into and from the recording medium and a communication line (not shown) which can allow information exchange by communication with external devices. Accordingly, the information processing device 510 can prepare image information to be recorded onto the recording medium charged in the disk driver 516 or into the recording unit 110 via the communication line as well as image information produced inside thereof. Further, a program controlling the recording reading multifunction device 100 is externally obtained and then installed.

Figure 7:
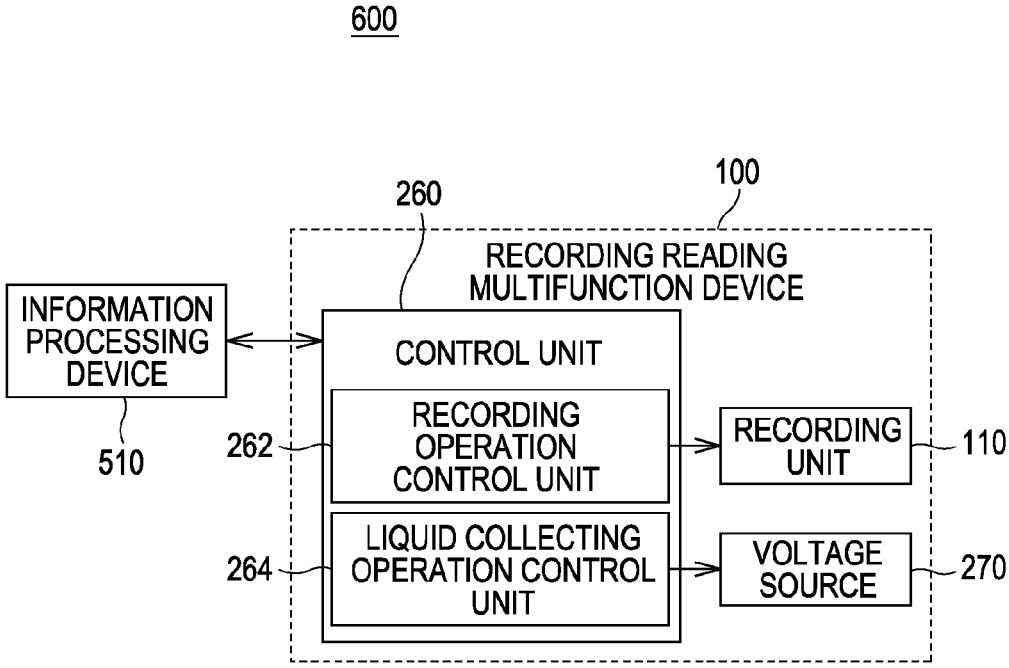
FIG. 7 is a schematic view illustrating structure of a control system in the system.

FIG. 7 is a schematic view illustrating structure of a control system 600 in the system 500 shown in FIG. 6.

In FIG. 7, the control unit 260 mounted in the recording unit 110 includes a recording operation control unit control unit 262 controlling recording operations in the recording unit 110 and a liquid collecting operation control unit 264 serving as the liquid collection control unit controlling the operation of the voltage source 270 in the aerosol collecting mechanism 300.

Accordingly, the recording operation in the recording unit 110 is performed in the recording unit 110 under the control of the recording operation control unit 262 according to instructions that the control unit 260 received from the information processing device 510, i.e. the host device. The voltage source 270 controls start and stop of voltage application by the voltage source 270 in corporation with the recording operation control unit 262 under the control of the control unit 260.

Figure 8:
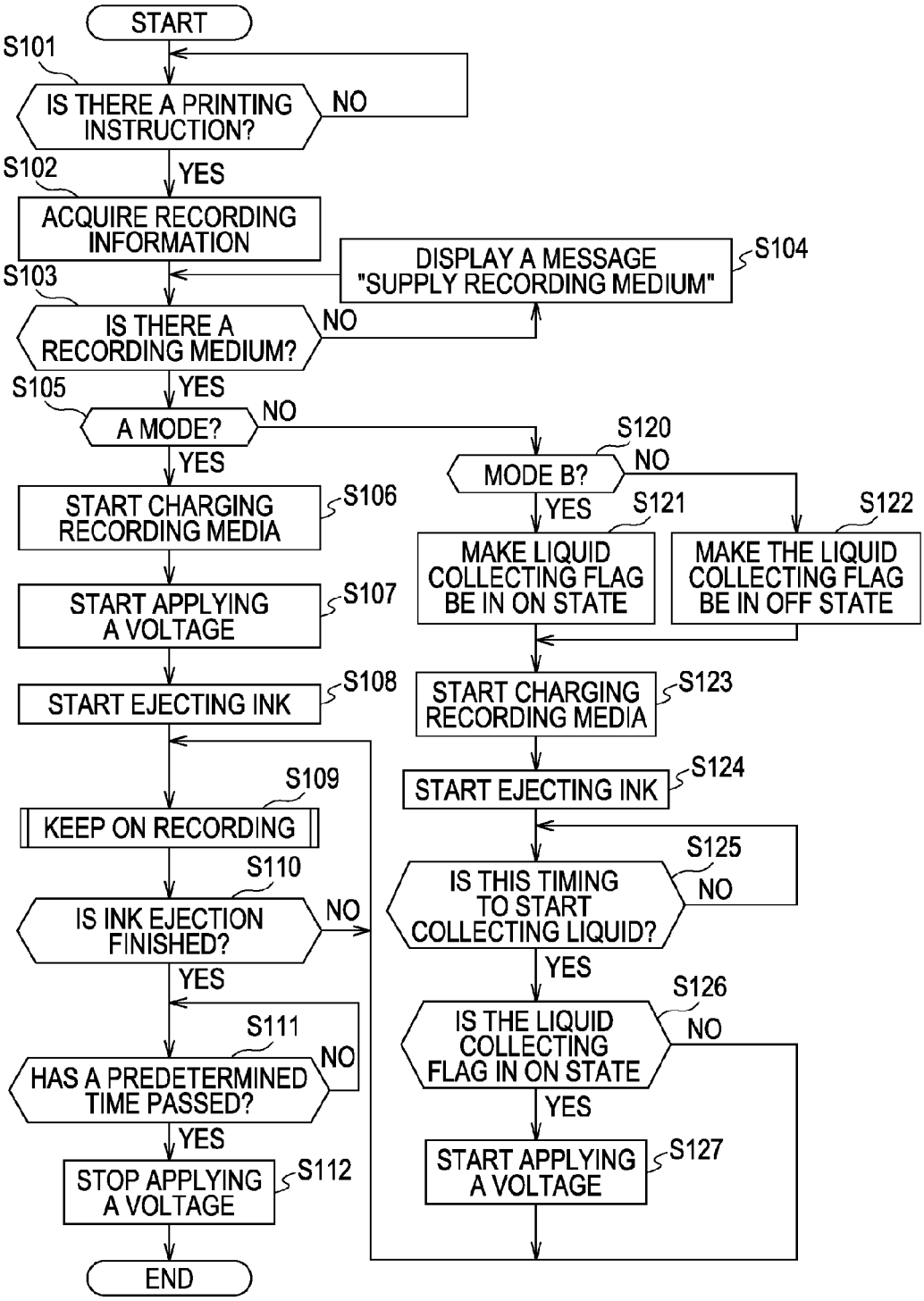
FIG. 8 is a flow chart illustrating control sequence of a control unit in the system.

FIG. 8 is a flow chart illustrating sequence of the case that the control unit 260 controls the operation of the aerosol collecting mechanism 300.

In FIGS. 7 and 8, the control unit 260 waits for a printing instruction from the host device such as the information processing device 510 connected to an external device (Step S101).

When received the printing instruction, recording information to be printed on the recording medium 150 is first obtained (Step S102). In addition, the recording information includes information about printing resolution, dimension of the recording medium 150, and the kind of the recording medium 150 besides image information to be printed.

Next, it is checked whether the recording medium 150 which is an object of the recording operation is charged in the recording unit 110 (Step S103). In the case in which the recording medium 150 is not charged (S103: NO), a message to the effect that the recording medium 150 must be charged ("recording medium supplement") is generated (Step S104) and waits until the recording medium 150 is charged. On the other hand, in the case in which the recording medium 150 is charged (S103: YES), a succeeding step is progressed.

In addition, information about the kind of a medium may be obtained from a judging unit which judges the kind of the recording medium 150 charged in the recording unit 110. The kind of a medium can be judged by measuring relative dielectric constant and bending rigidity and by optically measuring surface gloss and reflectivity of the recording medium 150. In this case, such a judgment is made after step S103 that the recording medium is charged.

Next, in Step S105, a control mode is selected on the basis of the obtained information about the kind of a medium. In the embodiment, the control mode includes a first control mode A, a second control mode B, and a third control mode C. The relationship between the kind of a medium and the corresponding control mode is shown in Table 1.

The mode A and the mode B are modes in which voltage application is performed, thereby controlling a voltage applying period, and the mode C is a mode in which the voltage application is not performed.

TABLE 1

| Kind of a medium | Mode |
|---|---|
| Plain paper | A |
| Specific Paper | A |
| Gloss paper | A |
| Matt coated paper | A |
| Gloss film | B.C |
| OHP sheet | B.C |
| Seal paper | B.C |

The plain paper means paper with a surface which is not processed or is not provided with a coating layer thereon. The specific paper means paper with a surface which is coated with a coating material. The gloss paper means paper with a surface which is coated and is glossy. The matte coated paper means paper with a surface which is coated with a coating material and which is not glossy.

The gloss film is made of synthetic resin film. The gloss film has a glossy surface but is opaque film. The OHP sheet is made of synthetic resin film, has a glossy surface, and is a transparent film. The seal paper means what paper and synthetic resin are adhered to each other.

Here, in the case in which the recording medium 150 has high relative dielectric constant, for example in the case in which the recording medium 150 includes synthetic resin film, the recording medium 150 accumulates a large amount of charge and thus it can be easily attracted to a structure of the recording unit 110 by an action of the electric field. Further, in the case in which the recording medium 150 has low bending rigidity, the recording medium 150 is easily bent with even weak action of the electric field with respect to the recording medium 150.

As described above, in the case in which the recording medium 150 is bent during transportation, it is difficult to guide the leading end of the recording medium 150 so as to be introduced between the discharge driving roller 245 and the discharge driven roller 244, and thus it becomes easy that the transportation failure occurs. The control mode selection of the aerosol collecting mechanism 300 relating to the present embodiment is set considering the relationship between the kind of a recording medium and the transportation failure attributable to the electric field.

In greater detail, with respect to the gloss film including synthetic resin, the OHP sheet, and the seal paper, the mode B and the mode C are selected due to easiness to accumulate charges and bending rigidity. In greater detail, in the case in which it is easy to accumulate charges and the bending rigidity is low, it is preferable that the mode C is selected.

In the case of the mode A, the recording medium 150 is started to be introduced by driving the feeding unit 210 of the recording unit 110, which is shown in FIG. 1 (Step S106).

Hereinafter, the mode A will be described with reference to FIGS. 7 and 8. The mode A includes Steps S106, S107, S108, S109, S110, S111, and S112.

If introduction of the recording medium 150 is started, voltage application is started by the voltage source 270 through the liquid collection control unit 264 (Step S107). Here, the reason that the voltage application is started before the recording operation in which aerosol is generated is that there is the case in which it takes a time for a high voltage applied in order to generate an electric field to be stabilized. In the above description, the operation in Step S107 is referred to as "voltage application starting," but can mean voltage application continuing in the case in which the voltage application is already started.

In addition, if the voltage application is continued, the applied voltage is stabilized, and the aerosol collecting by the electric field becomes effective, ink ejection toward the recording medium 150 in the recording unit 110 is started (Step S108).

The recording operation accompanied with the ink ejection is continued while image information to be recorded remains (Step S109). On the other hand, if the image information runs out, the control unit 260 stops ink ejection by the recording operation control unit 262 (Step S110).

However, even after the ink ejection is stopped and aerosol is not further generated, the voltage application is still continued until a predetermined time T passes (Step S111). This is because it takes a time for the aerosol generated around the nozzle plate 252 shown in FIG. 5 to reach the absorbing member 236 with respect to the recording operation. In such a manner, after the time T which is needed for the aerosol to reach the absorbing member 236 passed, the voltage application by the voltage source 270 is stopped (Step S112). In this manner, the recording operation of the recording unit 110 and a series of control operations of the control unit 260 relating to the liquid collecting operation control are completed. Here, the time T may be zero seconds.

Hereinafter, the control of starting and stopping of the voltage application in the mode A will be described in greater detail with reference to FIGS. 9 and 10.

Figure 9:
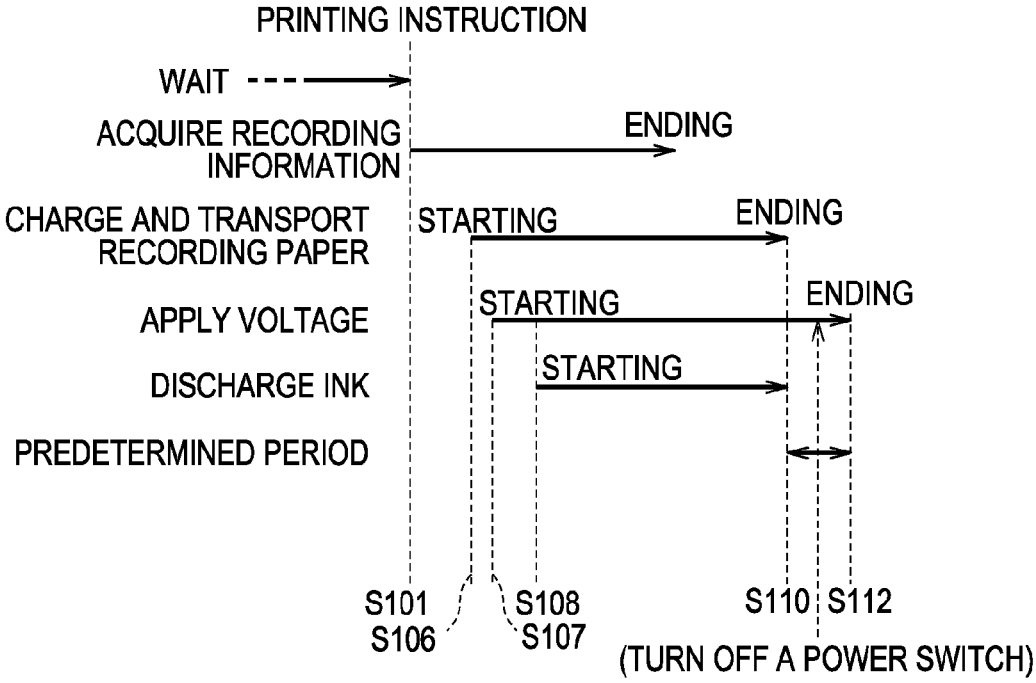
FIG. 9 is a timing diagram illustrating starting and ending points of operation periods in every portion of the recording unit.

FIG. 9 is a timing diagram illustrating starting and ending points of operation periods in every units of the recording unit 110 shown in FIG. 7.

Figure 10:
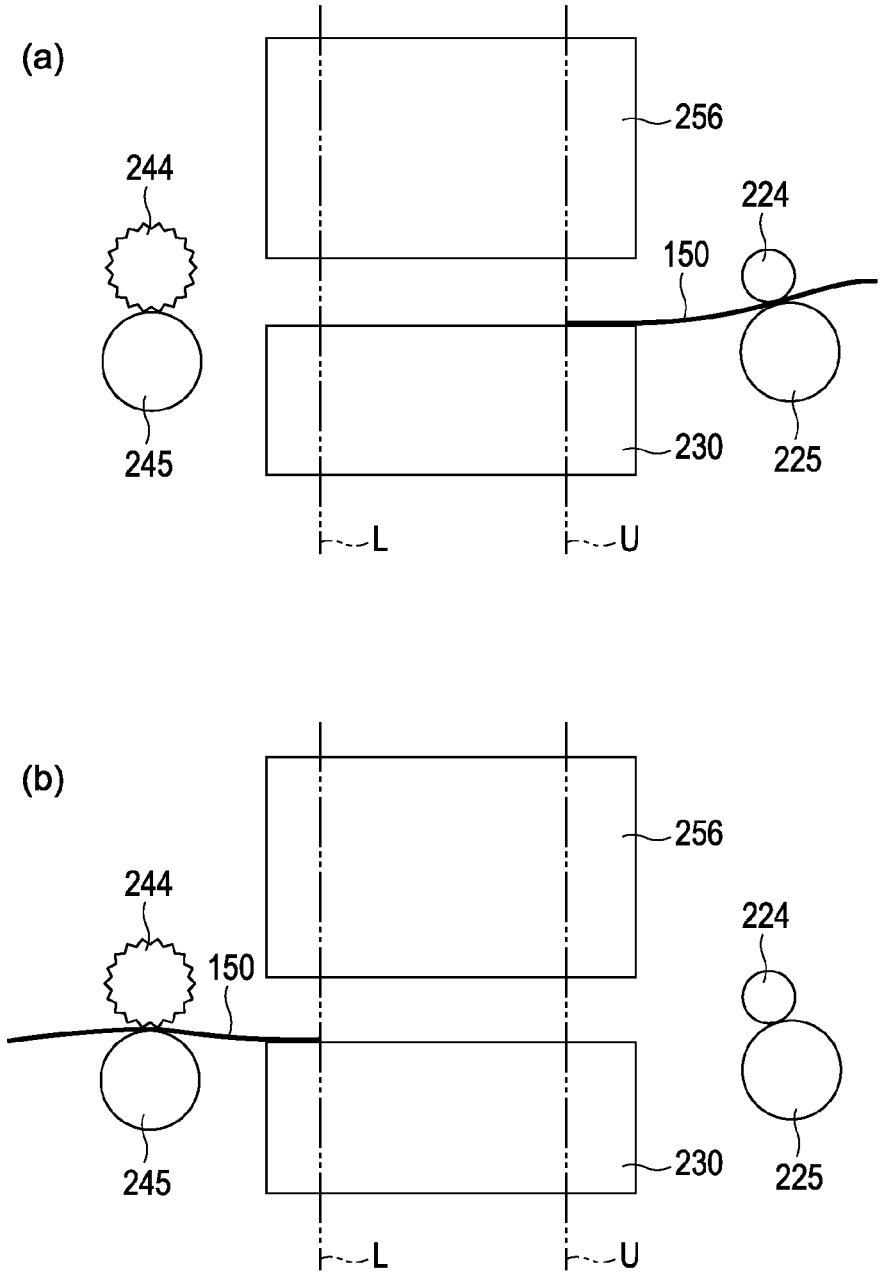
FIG. 10 is a schematic sectional view illustrating structure around a liquid ejecting head and the platen.

FIG. 10 is a schematic sectional view illustrating the liquid ejecting head 256 and around the platen 230. FIG. 10(*a*) is a view illustrating the timing of starting of the voltage application. FIG. 10(*b*) is a view illustrating the timing of stopping of the voltage application. A dashed two-dotted line U indicates the location of the outermost orifice 254 on the downstream side, and a dashed two-dotted line L indicates the location of the outermost orifice 254 on the upstream side.

In FIG. 10, the recording medium 150 is transferred to the platen 230 by the transportation driven roller 224 and the discharge driving roller 225. The transferred recording medium 150 is discharged by the discharge driven roller 244 and the discharge driving roller 245.

In FIG. 9, the recording medium 110 which has been in the stand-by state of waiting a printing instruction starts to acquire the recording information (Step S102) by receiving the printing instruction (Step S101). Subsequently, if a predetermined amount of the recording information which enables the recording operation to be performed is acquired, the control mode is selected according to the acquired information about the kind of a recording medium (Step S105).

In synchronization with acquiring of the recording medium, introduction and transportation of the recording medium 150 are started (Step S106). In addition, the voltage application is started (Step S107) before the ink ejection so that the application voltage is stabilized at the time of starting the ink ejection with respect to the recording medium 150 which is introduced.

In FIG. 10(*a*), the voltage application can be performed after the introduction and transportation of the recording medium 150 are started, but it is preferable that the voltage application is performed (Step S107) until the leading end of the recording medium 150 comes into contact with the transportation driven roller 224 and reaches the location of the dashed two-dotted line U, which is the location of the outermost nozzle 254 on the upstream side. After the leading end of the recording medium 150 reaches the location of the dashed two-dotted line U, which is the location of the outermost orifice on the upstream side, the ink ejection is started (Step S108).

The location of the dashed two-dotted line U is a position where the ink droplets 317 are ejected from the orifice 254 toward the recording medium 150, and is the outermost location on the upstream side.

The voltage application is continued even after the ink ejection with respect to the recording medium 150 is stopped, and the voltage application is stopped after a lapse of the predetermined time T (Step S111).

In FIG. 10(*b*), the voltage application is stopped after the back edge of the recording medium 150 passed the location of the dashed two-dotted line L, which is the location of the outermost nozzle on the downstream side (Step S112).

The location L of the dashed two-dotted line L is a position where the ink droplets 317 are ejected from the orifice 254 toward the recording medium 150 and the outermost location on the downstream side.

In addition, if the ink ejection is stopped and the recording medium 150 on which the image is recorded is discharged out of the recording unit 110, it is considered that the recording operation is finished. Accordingly, although the predetermined time T did not pass, it happens that a power switch of the recording reading multifunction device 100 is turned off. However, after the ink ejection is finished, it takes a time for aerosol generated by the ink ejected at the final stage to reach the absorbing member 236 and be absorbed by the absorbing member 236. Accordingly, it is preferable that the voltage application is maintained while the predetermined time T passes although the power switch is turned off.

In FIG. 8, Step S105 is followed by Step S120 in the modes other than the mode A. In Step S120, it is determined whether the liquid collecting is executed or not, and the determination result is displayed in a flag (Step S121 or S122).

The acquired information of the recording medium 150 is not information based on a characteristic value, such as relative dielectric constant and bending rigidity of the recording medium 150 but the information which directly shows the kind of the recording medium 150, which is provided by the information processing device 510. Accordingly, the recording unit 110 determines whether execution of the liquid collecting directly succeeds or not on the basis of the acquired information about the kind of the recording medium 150 (Step S120), and the determination result is display in the flag (Step S121 in the mode B and Step S122 in the mode C).

Hereinafter, the mode B will be described in detail. The mode B includes Steps S121, S123, S124, S125, S126, S127, S109, S110, S111, and S112.

Figure 11:
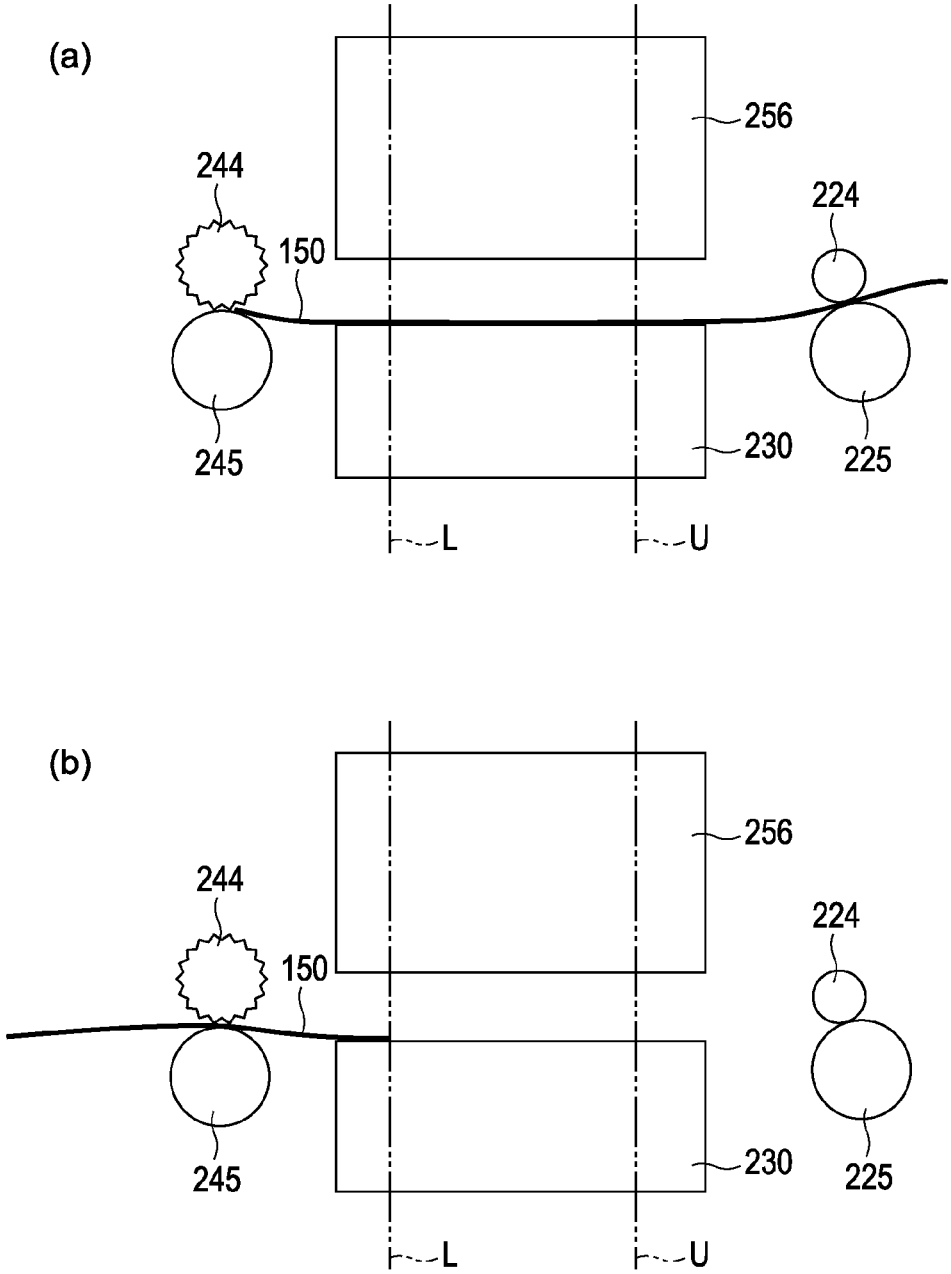
FIG. 11 is a schematic sectional view illustrating structure around the liquid ejecting head the platen.

FIG. 11 is a schematic sectional view illustrating the liquid ejecting head 256 and around the platen 230. FIG. 11(*a*) is a view illustrating timing of starting of the voltage application and FIG. 11 (*b*) is a view illustrating timing of stopping of the voltage application. The contents of references in these figures are the same as in FIG. 10.

After Step S120, the recording medium is introduced (Step S123) and then the ink ejection is started (Step S124).

The recording unit 110 refers the flag (Step S126) when the timing comes after waiting the starting timing of the voltage application for liquid collecting (Step S125) while it maintains the state of the flag. At the starting timing of the voltage application, the voltage application is started in the case in which the flag is in ON state (Step S127), thereby collecting liquid.

In FIG. 11(*a*), the voltage application is performed after the leading end of the recording medium 150 arrives at the position where the discharge driven roller 244 is disposed. In this case, the recording medium 150 is applied with bending force by influence of the electric field but there is no risk to cause jam because the leading end of the recording medium 150 is nipped by the discharge driving roller 245 and the discharge driven roller 244.

After that, the recording operation is continued (Step S109), and then the voltage application is stopped (Step S112) after the back end of the recording medium 150 passed the location of the dashed two-dotted line L, which is the location of the outermost orifice on the downstream side after finishing the ink ejection (Step S110), as shown in FIG. 11(*b*).

In Step S126, at the time of starting the voltage application, in the case in which the flag is in OFF state, the voltage application is not performed (Step S127) and the recording operation is continued (Step S109). This mode is the mode C.

In the mode C, since the voltage is not applied, operations of Steps S111 and S112 are not practically performed.

Hereinafter, additional controls when the recording operation is continued in Step S109 will be described.

Figure 12:
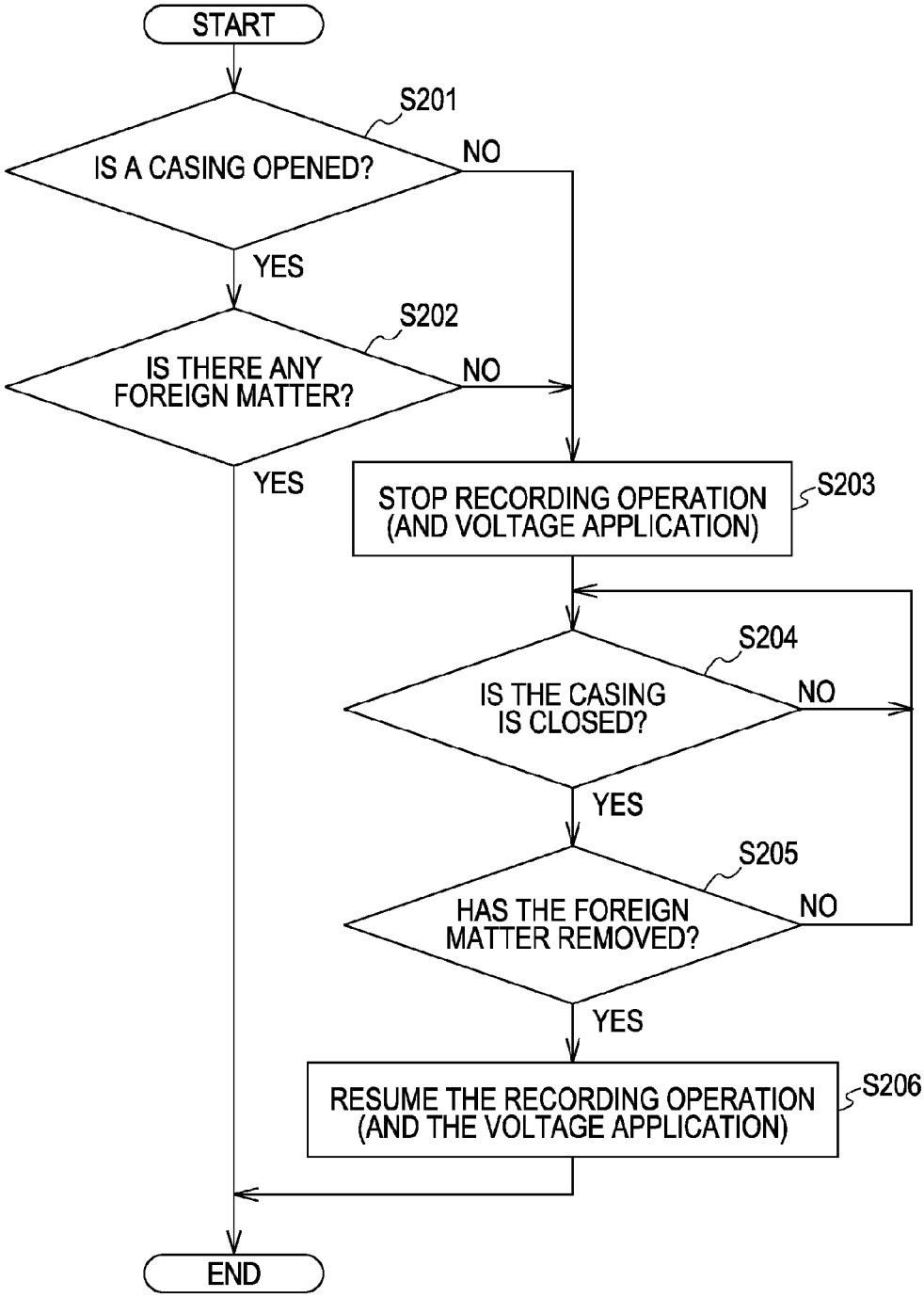
FIG. 12 is a flow chart illustrating additional control sequence of controls performed by the control unit during a period in which the recording operation is continued.

FIG. 12 is a flow chart illustrating sequence of additional controls in the recording operation in Step S109 of the sequence by the control unit 260 shown in FIG. 8.

As shown in FIG. 12, even in a period in which the recording operation is continued in Step S109, the control unit 260 monitors whether the upper casing 122 of the recording reading multifunction device 100, shown in FIG. 1, is closed or not (Step S201).

Here, in the case in which the upper casing 122 is opened for some reason (Step S201: NO), the control unit 260 stops the voltage application in the case in which a voltage is applied by the voltage source 270 (Step S203) as well as the control unit 260 stops the recording operation. With such a structure, it is possible to prevent the recording operation from being executed with the recording head exposed in the state in which the upper casing 122 is opened. Further, it is possible to prevent members, to which the voltage is applied by the voltage source 270, from being in the covered state, thereby preliminarily preventing electrical shock from occurring. Further, the control unit 260 monitors existence of foreign matters in the recording unit 110 (Step S202). In the case in which it is found that the foreign matter exists in the recording unit 110 (Step S202: NO), the control unit 260 stops the recording operation and stops the voltage application in the case in which a voltage is applied by the voltage source S270 (Step S203).

If the upper casing 122 is closed and the foreign matter has been removed (Step S204: YES, Step S205: YES), the recording operation is resumed (Step S206).

Unless the casing is closed (Step S204: NO) and the foreign matter has been removed (Step S205: NO), the recording operation is not resumed.

The above-described embodiment has the following advantages.

(1) With the control of the voltage application of the voltage source 270, performed by the liquid collecting operation control unit 264, it is possible to make the liquid collecting function effective when the need arises. Accordingly, it is possible to suppress power consumption and to control a high voltage application period, contributing to enhancement of safety of the recording unit 110. Further, since it is possible to make the function of collecting the satellite ink 315 and the ink droplets 317 effective when the need arises, it is possible to obtain the recording unit 110 in which the smudge attributable to the satellite ink 315 and the ink droplets 317 and the transportation failure of the recording medium 150 are suppressed to the minimum.

(2) Since the control mode relating to starting and stopping of the voltage application is selected on the basis of the information about the recording medium 150, it is possible to properly accomplish the above-mentioned advantage according to the recording media 150.

(3) Since the voltage application is suspended during a period in which the satellite ink 315 and the ink droplets 317 are not ejected, it is possible to suppress power consumption. Further, since the high voltage application period is limited, it is possible to contribute to the enhancement of the safety of the recording unit 110. Further, since the effective electric field is generated before the satellite ink 315 and the ink droplets 317 are ejected, it is possible to effectively collect the satellite ink 315 and the ink droplets 317.

(4) Since the voltage is applied after the recording medium 150 is nipped by the discharge driven roller 244 and is stably positioned, it is possible to prevent the recording media 150 from smudging as the recording media 150 are attracted to the absorbing member 236 by the electric field or to reduce occurrence of the transportation failure of the recording media 150 by preventing the recording media 150 from deviating from the transportation path.

(5) Since it is possible to prevent the electrode 310 is exposed in the air while it is applied with a voltage, it is possible to enhance the safety of the recording unit 110.

In the case in which an foreign matter exists in the recording unit 110 during the operation, it happens that damage is caused to the recording unit 110 in the case in which the recording operation is continued as well as the normal recording operation cannot be executed. Further, in the case in which the voltage is applied by the voltage source 270, it happens that the nozzle plate 252 and the electrode 310 are short-circuited due to the foreign matter. In addition, if the foreign matter is a user's hand, the user may get an electric-shock. Accordingly, in the case of preliminarily detecting the foreign matter, it is possible to prevent such damages from occurring by stopping the recording operation and the voltage application.

(6) It is possible to prevent the electric shock from occurring, which can occur by the short-circuit by the foreign matter or when trying to remove the foreign matter. Accordingly, it is possible to enhance the safety of the recording unit 110.

(7) In the recording unit 110 which can execute the sequence, it is not needed that the recording reading multifunction device 100 must be provided with a detecting unit which detects a characteristic value of the recording medium 150. Accordingly, it is possible to simplify a structure of the recording reading multifunction device 100.

Further, in the case of suspending or intermitting the voltage application for some reason by maintaining the state of the flag, it is possible to properly resume the voltage application by only referencing the flag.

(8) It is possible to collect even liquid droplets suspending in aerosol form after it is ejected from the liquid ejecting head. Accordingly, it is possible to suppress the smudge attributable to the aerosol to the minimum.

Further, even in the case in which power supply to the liquid ejecting apparatus is stopped right after the recording operation, the liquid droplets suspending in the aerosol form is collected. Accordingly, it is possible to suppress the smudge attributable to the aerosol to the minimum.

There may be at least two modes of the modes A, B, and C, and also there can be four or more modes.

Further, Step S103 and Step S104 can be omitted.

In addition, the invention is not limited to the above-described embodiment, and further various modifications other than the above-mentioned ones can be implemented without departing from the spirit of the invention.

For example, in the above embodiments, the case in which the relative dielectric constant and the bending rigidity of the recording medium 150 is selected as the characteristic value of the recording medium 150 is described, but the voltage source 270 can be controlled on the basis of other characteristic values. Further, it is also possible to control the voltage source 270 considering all of a variety of kinds of characteristic values.

In the above-described embodiments, the control unit 260 performs controls so as to start or stop the voltage application. However, the voltage application may be executed over a plurality of steps. For example, the bending rigidity of the recording medium 150 is classified into three kinds, and any one type of high voltage application, low voltage application, and halt of the voltage application is selected according to the kinds. Alternatively, the characteristic value, such as relative dielectric constant and bending rigidity of the recording medium 150 is measured on occasion, and a proper voltage corresponding to the detected characteristic value may be applied.

In addition, in a series of the above-described operations, in a period in which a voltage is applied to the electrode 310, it is preferable that the effect that the aerosol collecting mechanism 300 is operating and thus a voltage is applied to the electrode 310 is displayed by a display panel 132 or a pilot lamp 136 in the manipulation panel 130 of the recording reading multifunction device 100. With such an operation, it is possible to make a user note the voltage application so as to be careful for the electrode.

As described above, it is possible to reduce power consumption relating to the liquid collection by applying a voltage during a period in which the aerosol can be effectively collected. Further, it is possible to prolong the lifespan of the voltage source 270 by shortening the driving time. Still further, it is possible to reduce chances of electric shock occurrence by decreasing the voltage application period.

In the above description, an ink jet type recording device mounted in the recording reading multifunction device 100 as the recording unit 110 is exemplified as an example of the liquid ejecting apparatus. However, further exemplified as the liquid ejecting apparatus is a color filter manufacturing device of a liquid display, which has a color material ejecting head serving as the liquid ejecting head, an electrode forming device of an organic EL display, a field emission display (FED), and the like, which has an electrode material (conductive paste) ejecting head serving as the liquid ejecting head, and a bio chip manufacturing device having a bio-organic substance ejecting head serving as the liquid ejecting head and a precision pipette. Here, the recording object means general media to which the liquid ejected from the liquid ejecting head can be attached, and examples thereof include printed circuit boards, disk-type optical recording media, preparations, and the like.

Further, the invention is described using embodiments but the technical scope of the invention is not limited to the embodiments. It will be apparent to those skilled in the art that various modifications and variations may be made in the embodiments without departing from the spirit or scope of the invention. Thus, it is intended that the present invention cover the modifications and variations of this invention provided they come within the scope of the appended claims.

What is claimed is:

1. A liquid ejecting apparatus, comprising:

a liquid ejecting head including a conductive nozzle plate having orifices and ejecting liquid from the orifices toward a recording object;

an absorbing member disposed at a position farther from the liquid ejecting head than the recording object in a liquid ejecting direction so as to face the nozzle plate, and absorbing the liquid which is ejected from the liquid ejecting head but is not attached to the recording object;

an electrode arranged close to the absorbing member;

a potential difference creating unit creating a potential difference between the nozzle plate and the electrode by applying a voltage to the electrode so as to form an electric field, thereby making the liquid ejected from the liquid ejecting head be electrically attracted to the electrode; and a liquid collection control unit controlling a voltage application period of the potential difference creating unit such that in a first mode the potential difference is applied only during the period of time that the liquid is ejected from the orifices along with a predetermined amount of time required for the liquid ejected from the orifices to be absorbed by the absorbing member after the ejection of the liquid from the orifices is ended while in a second mode no potential difference is applied during the period of time that liquid is ejected from the orifices as no voltage is applied to the electrode during the second mode, wherein the liquid control unit determines whether to perform the first mode or the second mode based on acquired information about the type of recording object on which the liquid is to be ejected based on a relative dielectric constant of the recording object, such that when the acquired information indicates that the recording object has a high relative dielectric constant the liquid control unit determines to perform the second mode.

2. The liquid ejecting apparatus according to claim 1, wherein the liquid collection control unit starts the voltage application after the recording object comes into contact with a paper feeding roller and before the recording object reaches a position where the liquid is ejected from the orifices toward the recording object.

3. The liquid ejecting apparatus according to claim 1, wherein the liquid collection control unit starts the voltage application after the recording object comes into contact with a paper discharge roller.

4. The liquid ejecting apparatus according to claim 1, wherein the liquid collection control unit stops the voltage application after the recording object is displaced from a position where the liquid is ejected from the orifices to the recording object.

5. The liquid ejecting apparatus according to claim 1, wherein the liquid collection control unit stops the voltage application when a casing of the liquid ejecting apparatus is opened.

6. The liquid ejecting apparatus according to claim 1, wherein the liquid collection control unit stops the voltage application when it is detected that an object other than the recording object came into a casing of the liquid ejecting apparatus.

7. The liquid ejecting apparatus according to claim 1, wherein the liquid collection control unit starts the voltage application after the recording object comes into contact with a paper feeding roller and before the recording object reaches a position where the liquid is ejected from the orifices toward the recording object.

8. The liquid ejecting apparatus according to claim 1, wherein the liquid collection control unit starts the voltage application after the recording object comes into contact with a paper discharge roller.

* * * * *